US006125907A

United States Patent [19]

Tokuyama et al.

[11] Patent Number: 6,125,907

[45] Date of Patent: Oct. 3, 2000

[54] ELECTRICALLY-DRIVEN CLOSURE APPARATUS FOR BUILDING

[75] Inventors: Noriaki Tokuyama; Yoshihiro Otsuka, both of Tokyo, Japan

[73] Assignee: Sanwa Shutter Corporation, Tokyo, Japan

[21] Appl. No.: 09/354,339

[22] Filed: Jul. 16, 1999

[30] Foreign Application Priority Data

Nov. 18, 1998 [JP] Japan ..... 10-328136

[51] Int. Cl.[7] ..... A47G 5/02

[52] U.S. Cl. ..... 160/310; 160/189

[58] Field of Search ..... 160/310, 311, 160/312, 189, 133, 1, 7; 318/466, 467, 468, 469, 470, 280

[56] References Cited

U.S. PATENT DOCUMENTS 5,263,527 11/1993 Marlatt et al. ..... 160/310 X 5,847,525 12/1998 Chéron et al. ..... 160/310 X

*Primary Examiner*—Jerry Redman

*Attorney, Agent, or Firm*—Arent, Fox, Kintner, Plotkin & Kahn PLLC

[57] ABSTRACT

An electrically-driven closure apparatus for building includes the following parts: a shutter curtain, a driving device for driving the shutter curtain to open and close an opening by forward and backward driving power of an electric motor, the driving device being rotationally displaceable forward and backward relative to a fixed part in accordance with load applied thereto; a forward load detecting spring disposed between the driving device and a fixed member or the frame, so as to produce force which resists forward rotational movement of the driving device; a backward load detecting spring disposed between the driving device and a fixed member or the frame, so as to produce force which resists backward rotational movement of the driving device; and sensors for detecting the rotational displacements of the driving device. Spring constants of the forward and backward load detecting springs are independently adjustable.

8 Claims, 13 Drawing Sheets

ELECTRICALLY-DRIVEN CLOSURE APPARATUS FOR BUILDING

BACKGROUND OF THE INVENTION

1. Field of the Invention

The present invention relates to an electrically driven closure apparatus for architectures, such as an electrically-driven shutter of a building.

2. Description of the Related Art

Generally, a closure apparatus having an electric motor to drive a closure member for opening and closing, for example, an entrance of a building has a risk of being jammed with an obstacle when being operated. Therefore, the apparatus preferably has an obstacle detector and an automatic stop controller that automatically stops the closure member when the obstacle detector detects the obstacle. Two types of the obstacle detector are known: one is a direct detecting type that detects an obstacle by a detecting sensor such as a seat plate switch provided on the closure member; the other is an indirect detecting type that detects an obstacle indirectly by detecting load variation or torque variation of the electric motor that occurs when the closure member is blocked by the obstacle. The indirect type detector has an advantage in that the closure member is not required to have an obstacle sensor and that the obstacle detector can also serve as a limit detector. Conventionally, the indirect type obstacle detector may detect the load variation in accordance with a variation of a rotation speed or an electric current value (or a voltage value). However, a general electric closure apparatus utilizes an electric motor working within a range where the variation of the rotation speed due to the load variation is small, so as to obtain a stable opening and closing speed. Therefore, there is a problem that the variation of the motor speed is small when the closure member is resisted by an obstacle. Another problem experienced with the current detecting type is that the electric current can also be varied by a disturbance other than the load variation. Thus, the above-mentioned detectors have difficulty in detecting an obstacle with high accuracy and good compatibility between detection sensitivity and operation stability.

In order to solve the above-described problem, a mechanism has been proposed which can perform stable opening and closing operation while detecting an obstacle accurately. In this mechanism, an electric motor or a driving device serves as a displaceable member that changes its position in accordance with the load variation. The displaceable member is supported by a load detecting spring (a neutral position keeping spring) that keeps, under a predetermined load, the displaceable member at a neutral position with respect to a fixed member that is fixed to a frame. A displacement sensor detects change in the position of the displaceable member that moves against the load detecting spring.

During the closing operation, it is necessary that the detection of obstacle be performed with high accuracy, in order that the electric motor is stopped without delay upon detection of any obstacle. In contrast, during the opening operation, the detection sensitivity is preferably set to a low level, in order to ensure smooth and stable movement of the closure member in the opening direction.

However, the conventional load detecting spring mentioned above employs a single substantially a U-shape spring member so that an equal spring constant is applied both in the closing and opening operations. This means that the levels of the detection sensitivity during the closing and opening operations are the same. Consequently, it has been necessary that the spring constant of the detection spring be set to a level which is a compromise between the high sensitivity required during closing and the low sensitivity required during opening. This is the problem to be solved by the present invention.

SUMMARY OF THE INVENTION

Accordingly, it is a primary object of the present invention to provide an electrically-driven closure apparatus for a building which is improved to overcome the above-described problems of the known arts.

To this end, according to the present invention, there is provided an electrically-driven closure apparatus for building, comprising: a closure member for opening or closing an opening in a building structure; a driving device for driving the closure member by forward and backward driving power of an electric motor, the motor or the driving device being designed to serve as a displaceable member that changes rotational position relative to a fixed member fixed to the building structure, in accordance with a variation in the load; a forward load detecting spring disposed to act between the displaceable member and the fixed member so as to resist a forward rotational displacement of the displaceable member; a backward load detecting spring disposed to act between the displaceable member and the fixed member so as to resist a backward rotational displacement of the displaceable member; and displacement sensors for detecting displacements of the displaceable member against the spring forces of the forward and backward load detecting springs.

The amount of displacement of the displaceable member is substantially proportional to the load acting on the motor, i.e., the reacting torque. The level of the load acting on the motor can therefore be directly detected by the displacement sensor. As a consequence, load detection can be achieved with higher level of accuracy than in the known apparatuses in which the load acting on the motor is detected indirectly through measuring a change in the motor speed or the electrical current. Forward rotational displacement and backward rotational displacement of the displaceable member is sensed by the forward and backward load detecting springs, respectively. Consequently, high level of detection accuracy for detecting any obstacle during closing movement of the closure member can be obtained by virtue of the forward load detecting spring having high sensitivity to load variation, while stable and smooth closing operation is ensured by the backward load detecting spring which has comparatively low sensitivity to load variation.

In this apparatus, each of the forward and backward load detecting springs may be formed substantially in U-shape or linear shape.

The arrangement may be such that the displaceable member is rotatable around the axis of the motor shaft, and the rotational displacements of the displaceable member in accordance with the load variation are detected by the displacement sensors.

Alternatively, the arrangement may be such that the displaceable member is supported rotatably by a fixed shaft to rotate around the axis of the fixed shaft, and the rotational displacements of the displaceable member in accordance to the load variation are detected by the displacement sensors.

The above and other objects, features and advantages of the present invention will become clear from the following description of the preferred embodiments taken in conjunction with the accompanying drawings.

DESCRIPTION OF THE PREFERRED EMBODIMENTS

Figure 1:
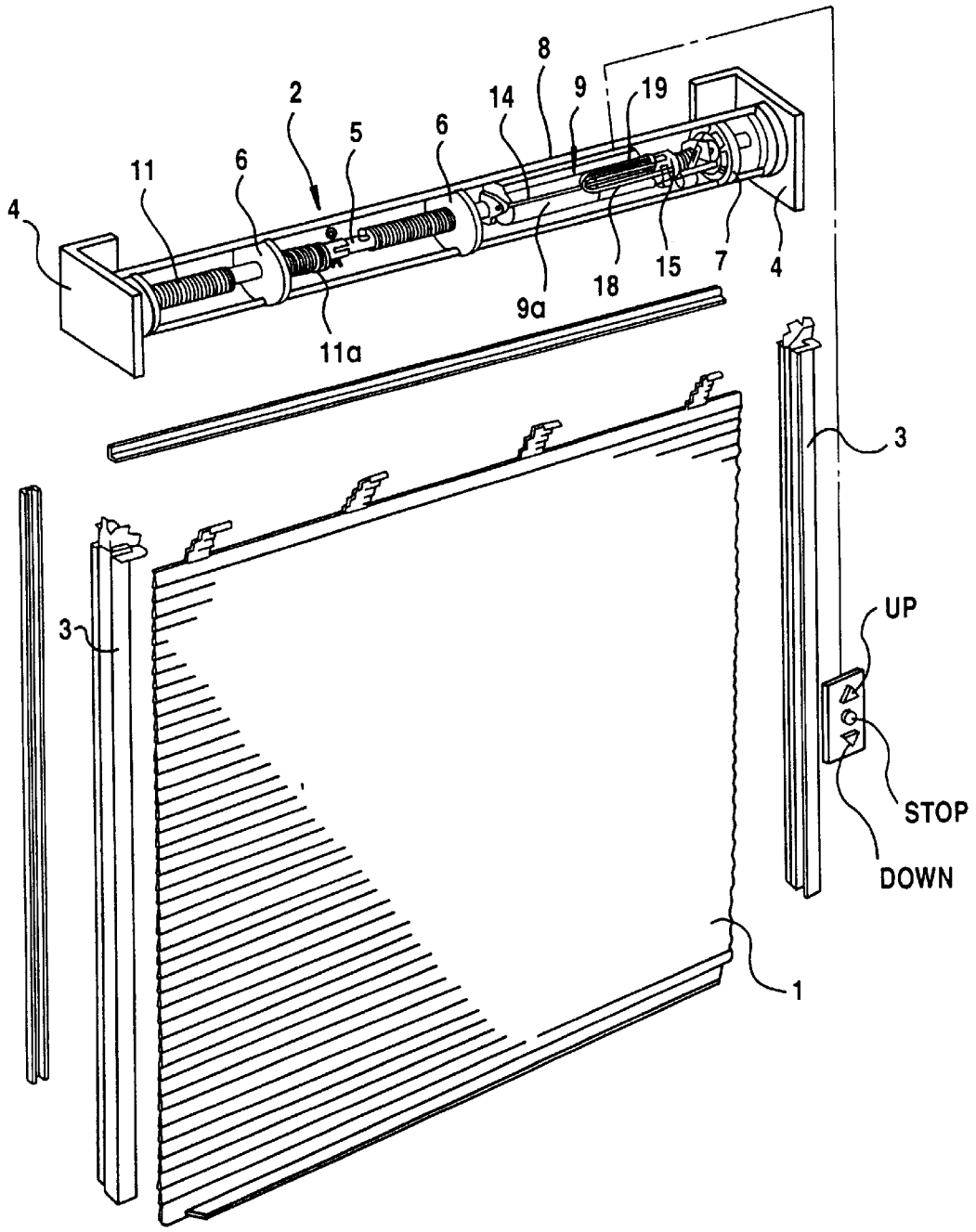
FIG. 1 is an exploded perspective view of an electrically-driven shutter for a building, as an embodiment of the electrically-driven closure apparatus of the present invention.
Figure 2:
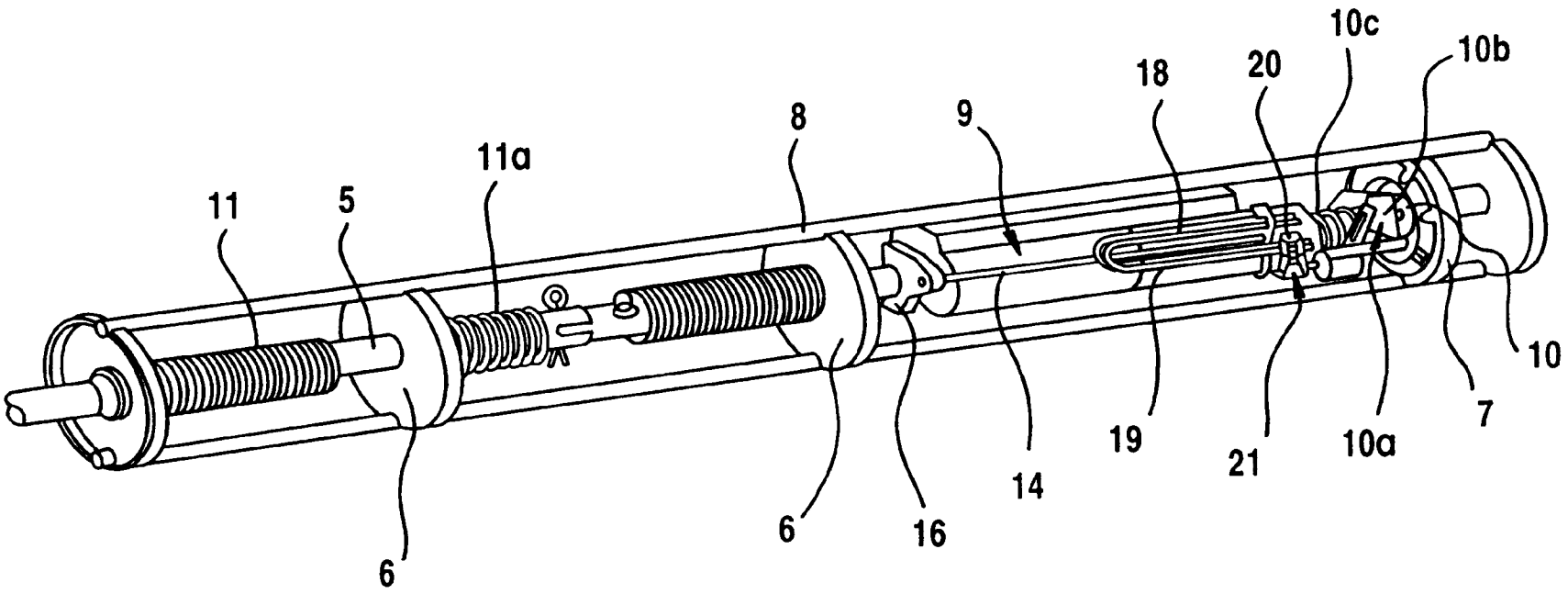
FIG. 2 is a perspective view of a take-up drum.
Figure 3B:
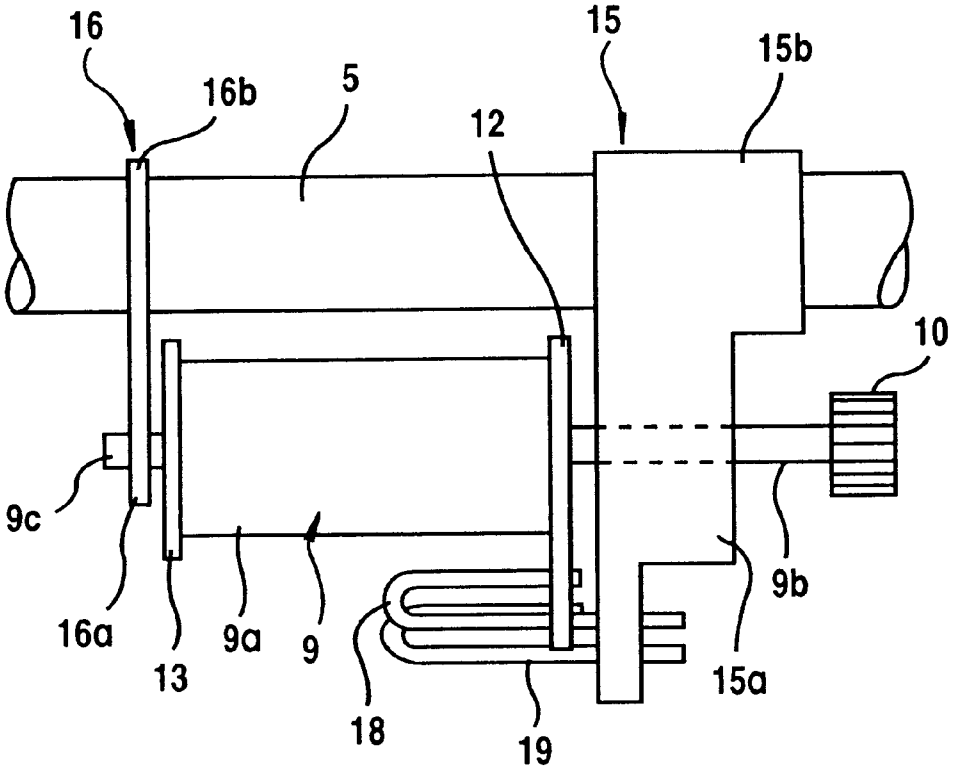
FIG. 3B is a schematic partial front view of the shutter.
Figure 3A:
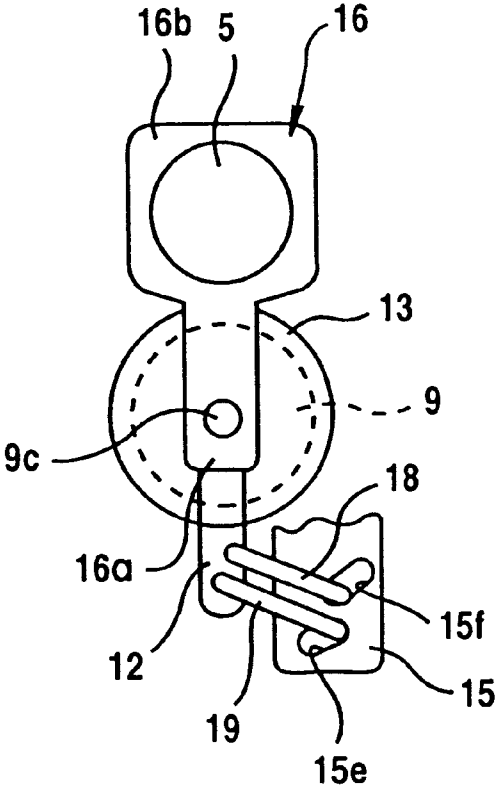
FIG. 3A is a schematic side view of the shutter.
Figure 4:
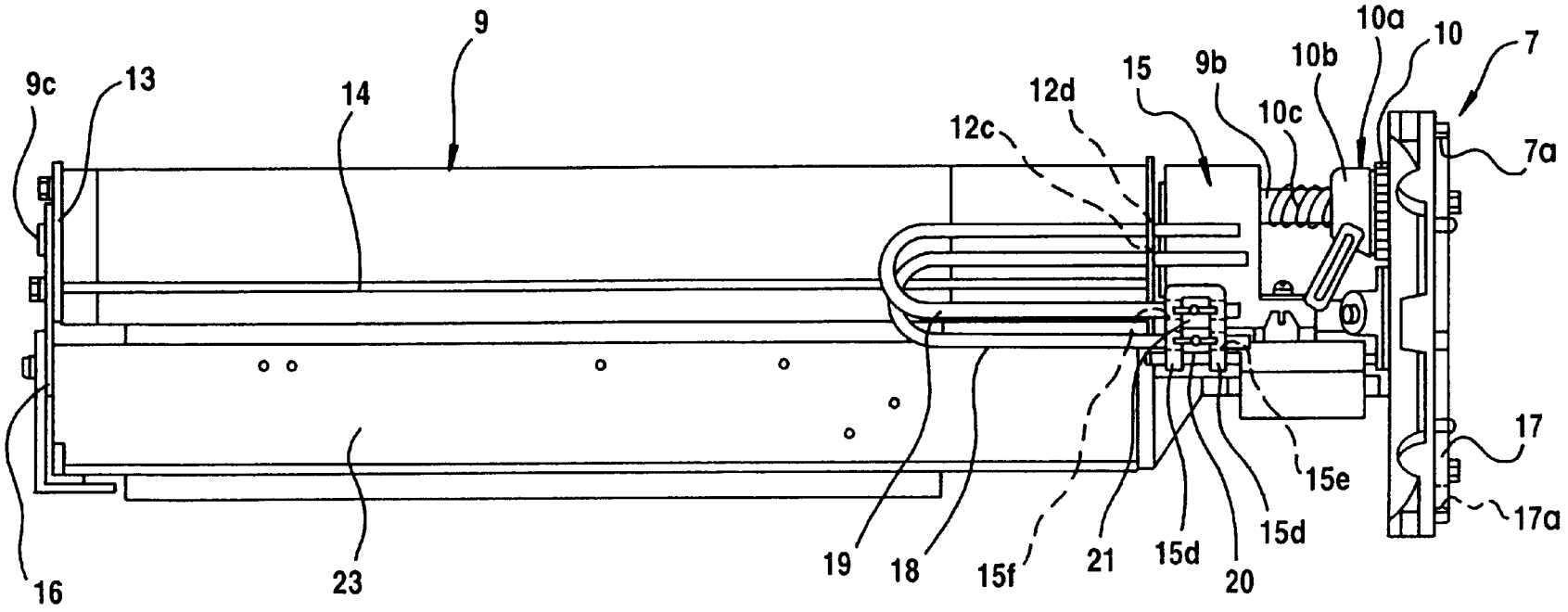
FIG. 4 is a front view of the driving device.
Figure 5:
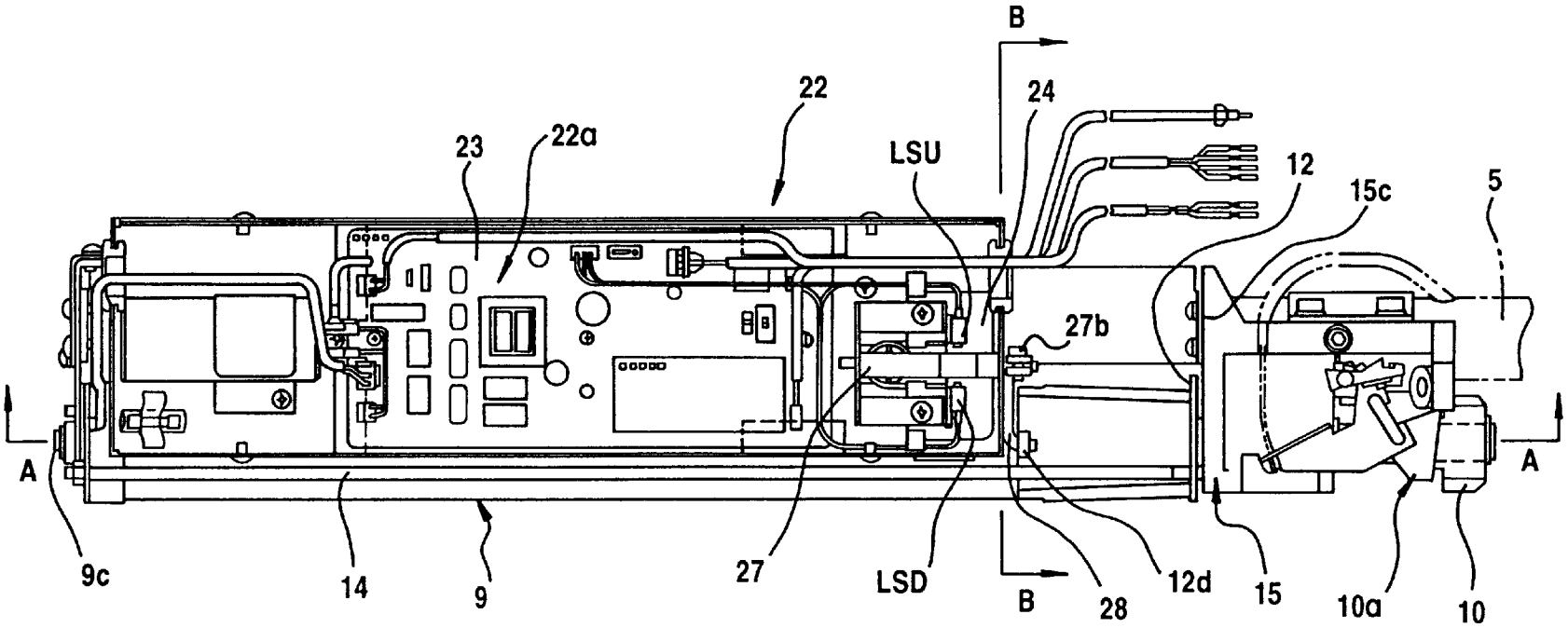
FIG. 5 is an upper rear view of the driving device.
Figure 6:
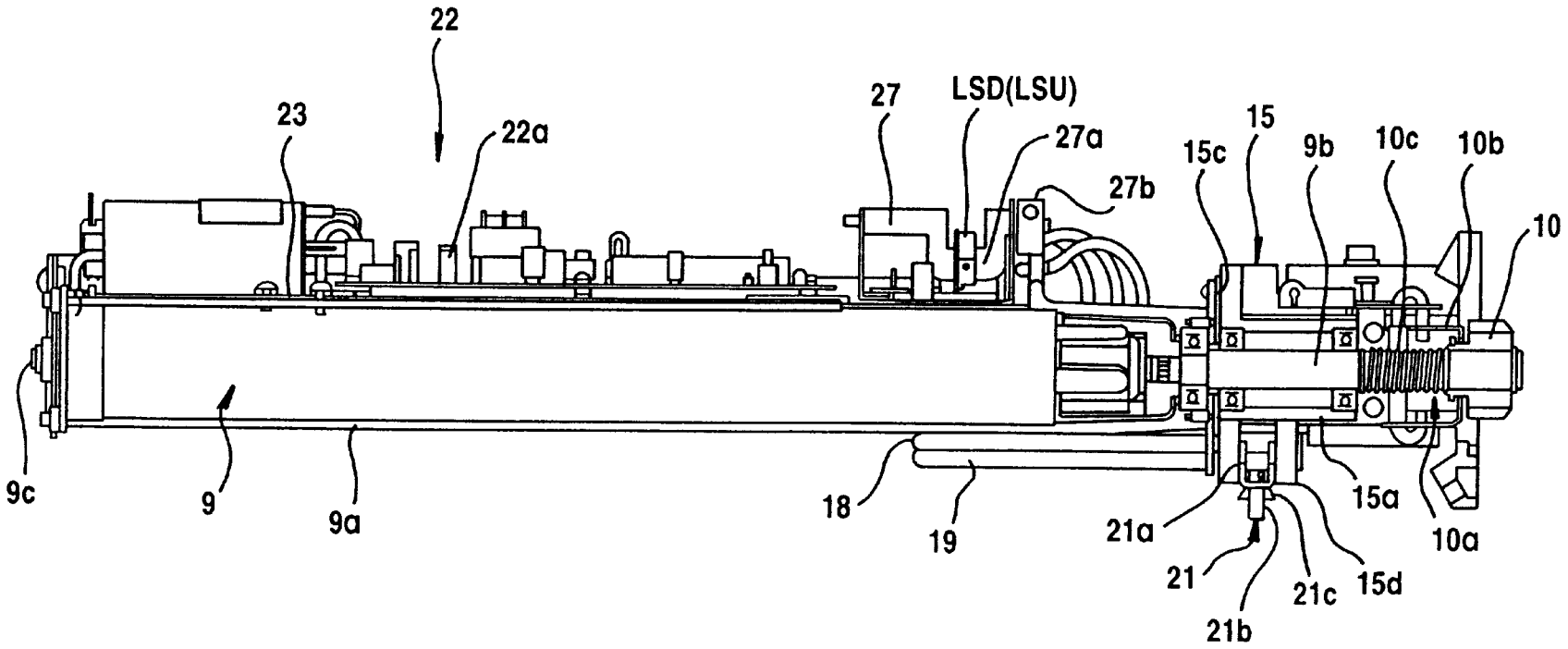
FIG. 6 is a cross section along A—A line in FIG. 5.

A first embodiment of the present invention will be described with reference to FIGS. 1 to 9.

In these figures, reference numeral 1 denotes a shutter curtain of an electrically-driven shutter for a building. The shutter curtain 1 is arranged to be scrolled up and down between an open position where it is wound on a take-up drum to open, for example, an entrance opening, and a close position where it has been unwound to close the entrance. This structure is the same as that of conventional shutters. Numeral 3 denotes guide rails that are disposed vertically at right and left sides of the opening to guide the right and left sides of the shutter curtain 1.

The take-up drum 2 includes a fixed shaft 5 that is fixed between a pair of brackets 4, 4 disposed at an upper portion of the frame, a plurality of wheels 6 disposed rotatably around the fixed shaft 5, an internally-toothed ring gear 7, and a stay 8 that connects the wheels 6 and the internally-toothed ring gear 7 integrally. In this embodiment, the internally-toothed ring gear 7 is disposed at one end of the fixed shaft 5. At one end of the fixed shaft 5, a driving device 9 is also attached. This driving device 9 has an electric motor of an inner drum type. The driving device 9 has an output shaft (a motor shaft) 9*b* extending from an end of the cylindrical casing 9*a* of the driving device 9. An output gear (pinion gear) 10 is disposed integrally with the end portion of the extending output shaft 9*b*. The output gear 10 engages with the internally-toothed ring gear 7 so that the driving force of the driving device 9 is transmitted to the take-up drum 2. Between the fixed shaft 5 and the winding wheels, a balance spring 11 and a cushion spring 11*a* are disposed. The arrangement is such that the shutter curtain 1 is opened or closed while a differential between the weight of the shutter curtain 1 varying in accordance with the position of the shutter curtain 1 and the force of the balance spring 11 is compensated for by the driving force exerted by the driving device 9.

Power transmission between the output gear 10 and the internally-toothed ring gear 7 is performed via a clutch 10*a*, which includes a working member 10*b* that causes the output gear 10 provided on the extending output shaft 9*b* to move in the axial direction, and a spring device 10*c* that urges the output gear 10 into engagement with the internally-toothed ring gear 7. By retracting the output gear 10 against the urging force of the spring device 10*c*, the output gear 10 is disengaged from the internally-toothed ring gear 7 to terminate power transmission.

Numerals 12 and 13 denote first and second holders that are attached to both ends of the casing 9*a* integrally therewith. The first and second holders 12, 13 are connected integrally via stays 14. The extending output shaft 9*b* rotatably extends from the first holder 12, while a rear extending shaft 9*c* rotatably extends from the second holder 13. Numerals 15 and 16 denote first and second brackets. Bearing portions 15*a*,16*a* and fixed shaft attachment portions 15*b*, 16*b* are formed integrally on the first and second brackets 15 and 16. Extending portions of the extending output shaft 9*b* and the rear extending shaft 9*c* are journaled by the bearing portions 15*a*, 16*a*, while the fixed shaft 5 is fixed to the fixed shaft attachment portions 15*b*, 16*b*. Thus, the driving device 9 (inclusive of the first and second holders 12, 13) are supported for pivotal motion about the axis of the motor shaft with respect to first and second brackets 15, 16 (fixed shaft 5).

Numeral 12*a* denotes a pair of stoppers provided on the first holder 12. The stopper 12*a* abuts the fixed shaft 5 to stop the rotation of the first holder 12 when the same has rotated together with the driving device 9 by a certain large angle (e.g., ±12 degrees), thereby limiting the range of rotation of the driving device 9.

Numeral 17 denotes a guide plate which is integrally attached to the first bracket 15 and which is received in the internally-toothed ring gear rotatably, and numeral 17*a* denotes a guide roller that engages with and rolls along a guide groove formed in the internally-toothed ring gear 7.

First and second load detecting springs 18 and 19 which will be detailed later and which serve as the forward and backward load detecting springs are connected between the first holder 12 that is the pivotable part and the first bracket 15 that is the fixed part. The load detecting springs 18, 19 support the pivotable driving device 9 (the first holder 12) with zero spring force at substantially middle position (±0 degree) of the above-mentioned range of pivotal movement, i.e., at a neutral position, when the driving device 9 is in its inoperative state. The arrangement is such that the load detecting spring 18 or 19 produces resisting force according to its peculiar spring constant when the driving device 9 pivots from the neutral position in forward or backward direction.

More specifically, the first holder 12 is provided with a protuberance 12*b*, in which are formed a first-spring receiving hole 12*c* and a second-spring receiving hole 12*d* at radially inner and outer portions of the protuberance 12*b*. Meanwhile, the first bracket 15 has a pair of protuberances 15*d* that are axially spaced from each other. Each protuberance 15*d* has a first-spring receiving hole 15*e* and a second-spring receiving hole 15*f* which are formed at radially inner and outer portions thereof. Each of the first and second load detecting springs 18, 19 has a substantially U-shaped configuration. The first load-detecting spring 18 has both ends slidably received in the first-spring receiving holes 12*c*, 15*e*. Similarly, the second load detecting spring 19 has both ends which are slidably received in the second-spring receiving holes 12*d*, 15*f*. The first and second load detecting springs are caused to slide to suitable positions and are fixed at such positions by means of first and second spring fixing members 20 and 21. In this state, the first and second load detecting springs 18, 19 are disposed in a side-by-side fashion at a radial distance from each other, while exhibiting predetermined spring constants and, in this state, the driving device 9 is held at the neutral position. The first-spring receiving hole 12*c* and the second-spring receiving hole 12*d* have arcuate slot-like forms concentric with the outer peripheral surface of the casing 9*a* of the driving device 9. When the driving device 9 is in the neutral position as described above, the first load detecting spring 18 engages with an end of the arcuate slot of the first-spring receiving hole 12*c*, i.e., at the upper end of the arcuate slot as viewed in FIG. 6. On the other hand, the second load detecting spring 19 engages with an end of the arcuate slot of the second-spring receiving hole 12*d*, i.e., at the lower end of the arcuate slot as viewed in FIG. 6.

The first and second spring fixing members 20, 21 are provided side-by-side between the pair of protuberances 15*d* of the first bracket 15*d*, at a spacing in the direction of the circumference of the protuberances 15*d*. The first and second spring fixing members 20, 21 have an identical construction. Only the first spring fixing member 20 is therefore described in detail, and the construction of the second spring fixing member 21 is omitted.

The spring fixing member 20 includes a U-shaped fixing metal 20*a*, through both leg portions of which one end of the first load detecting spring 18 loosely extend and which is slidably disposed between the protuberances 15*d*. The spring fixing member 20 also includes a butterfly bolt 20*b* having an end penetrating through the fixing metal 20*a* into and out of contact with the first load detecting spring 18, and a nut 20*c* that engages with the butterfly bolt 20*b* and prevented by the legs of the fixing metal 20*a* from rotating. By rotating the butterfly bolt 20*b* relatively to the nut 20*c*, the tip of the butterfly bolt 20*b* abuts or leaves the load detecting spring 18, so that the movement of the load detecting spring 18 is restricted (i.e., the spring 18 is fixedly attached) or released.

Each of the first and second load detecting springs 18 and 19 produces a resilient force at its U-shaped portion outside the portion where the spring is fixed by the spring fixing member 20 or 21. Thus, each of the first and second load-detecting springs 18, 19 is fixed by the associated spring fixing member 20, 21 after the effective length, i.e., the length of the U-shaped portion outside the portion to be fixed by the fixing member, whereby the spring constant of each load detecting spring 18, 19 is adjustable.

The butterfly bolts 20*b* are 21*b* adapted to be tightened and loosened to fix and release the associated load detecting springs 18 and 19. The butterfly bolts 20*b*, 21*b* are rotatable in the circumferential direction of the protuberances 15*d* to positions where they are offset from each other in the direction of the circumference of the protuberances 15*d*, thus facilitating the manipulation for adjusting the spring constants of the first and second load detecting springs 18, 19.

When the driving device 9 held in the neutral position is overloaded, the driving device 9 pivots by a reacting torque that is counter to the direction of the overload. Namely, in the case where the shutter curtain 1 is blocked by an obstacle or reaches the closing limit position (grounding position), imbalance is caused between the weight of the shutter curtain 1 and the spring force of the balance spring 11. Therefore, the driving device 9 may pivot a large angle (e.g., more than +6 degrees) in a forward direction (direction of the arrow X in FIG. 7) against the load detecting spring 18. Conversely, when the shutter curtain 1 reaches the opening limit position, i.e., a full-open position where the end of the curtain 1 engages with the edge of the outlet slot, tensile force is applied to the shutter curtain 1 to cause the driving device 9 to pivot a large angle (e.g., −6 degrees)l in the backward direction (direction of the arrow Y in FIG. 7).

Figure 7:
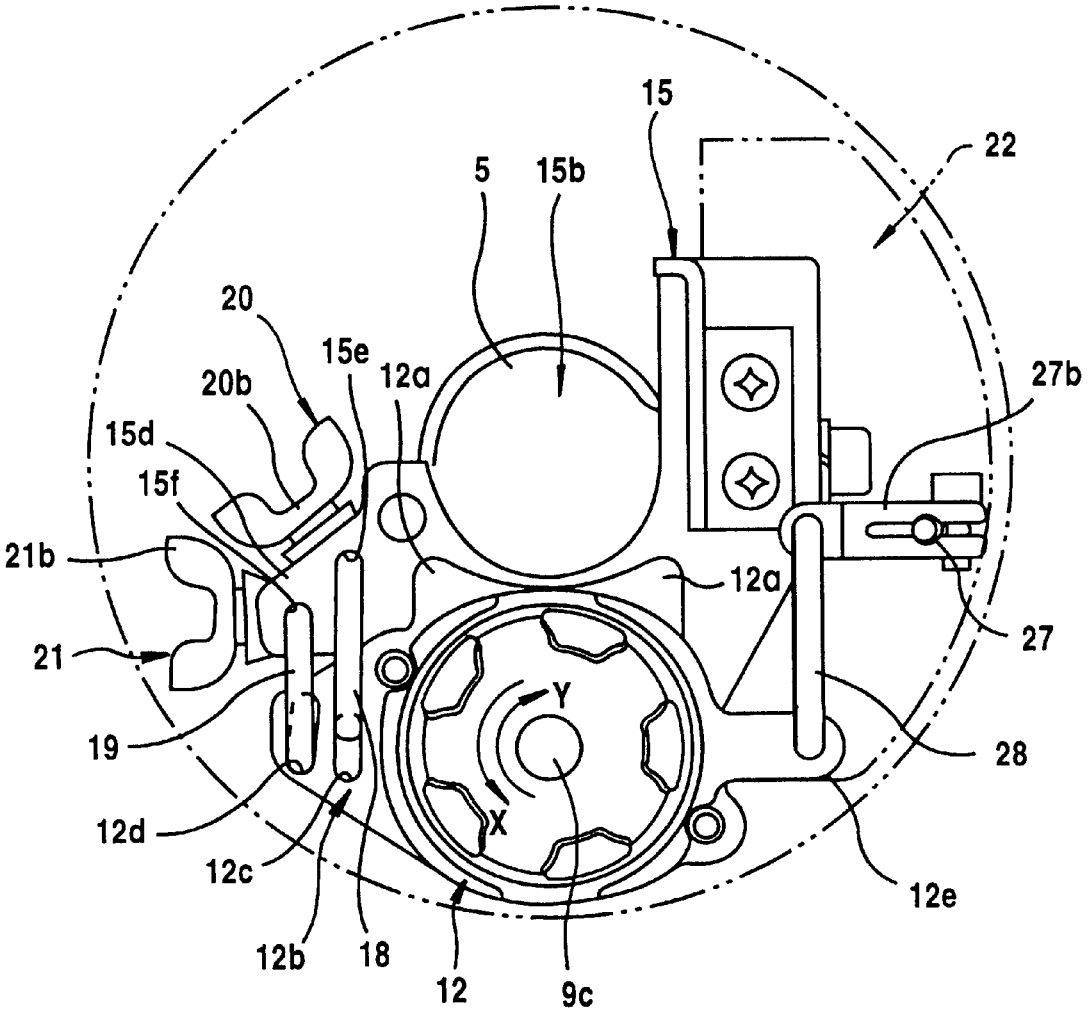
FIG. 7 is a cross section along B—B line in FIG. 5.
Figure 8:
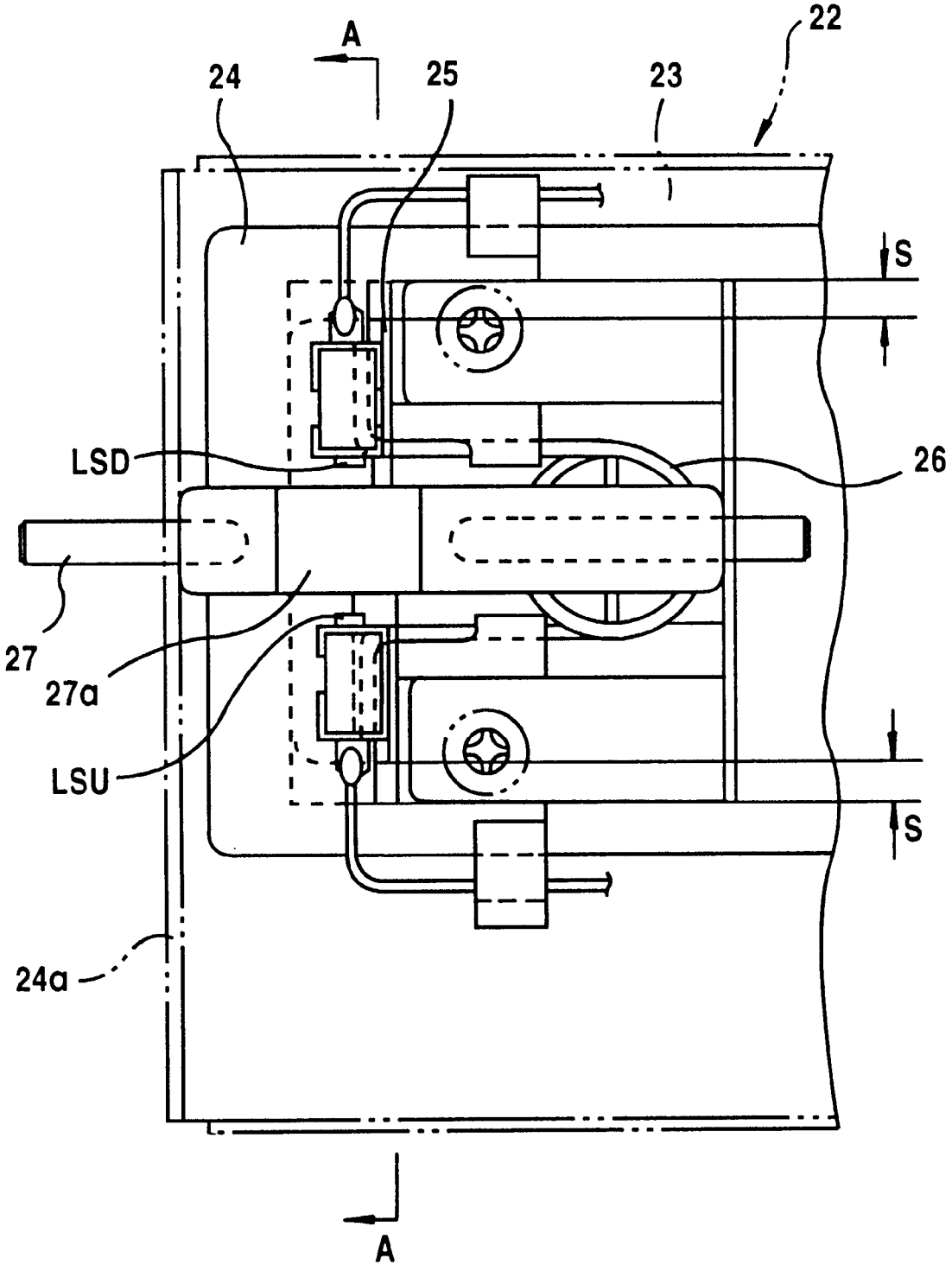
FIG. 8 is a plan view of a limit switch.
Figure 9A:
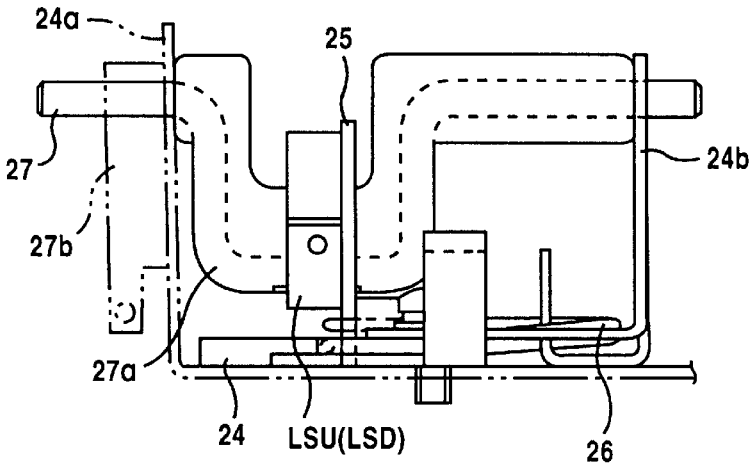
FIG. 9A is a front view of the limit switch shown in FIG. 8.
Figure 9B:
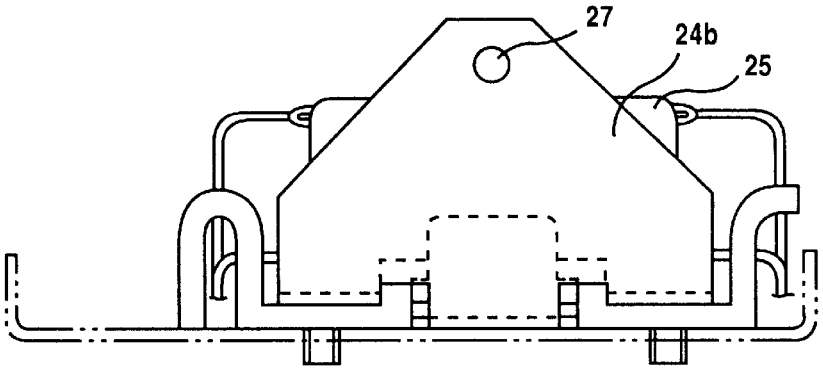
FIG. 9B is a right side view of the limit switch shown in FIG. 8.
Figure 9C:
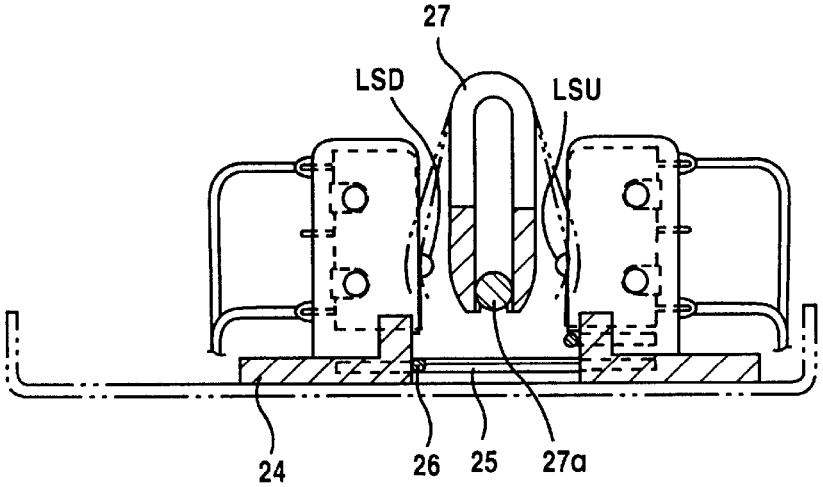
FIG. 9C is a cross section along A—A line in FIG. 8.

The pivotal motion of the driving device 9 in the forward direction, i.e., in the direction of the arrow X in FIG. 7, that takes place during closing of the shutter curtain 1, is resisted by the first load detecting spring 18 that engages with one end of the arcuate slot of the first-spring receiving hole 12*c*. This causes the first load detecting spring 18 to be resiliently deformed in a direction for urging both legs of the first load detecting spring 18 away from each other. In the meantime, the second load detecting spring 19 slides along the arcuate slot of the second-spring receiving hole 12*d* so as not to exert any force on the driving device 9 which pivots in the forward direction. Thus, the first and second load detecting springs do not interfere with each other when the driving device 9 pivots in the forward direction.

Conversely, the pivotal motion of the driving device 9 in the backward direction, i.e., in the direction of the arrow Y in FIG. 7, that takes place during opening of the shutter curtain 1, is resisted by the second load detecting spring 19 that engages with one end of the arcuate slot of the second-spring receiving hole 12*d*. This causes the second load detecting spring 19 to be resiliently deformed in a direction for urging both legs of the first load detecting spring 18 toward each other. In the meantime, the first load detecting spring 18 slides along the arcuate slot of the first-spring receiving hole 12*c* so as not to exert any force on the driving device 9 which pivots in the backward direction. Interference between the first and second load detecting springs 18, 19 is avoided also when the driving device 9 pivots in the backward direction. It will be understood that any overload that occurs during closing of the shutter curtain 1 and any overload that takes place during opening of the same are resisted exclusively by the first and second load detecting springs 18 and 19, respectively, whereby different levels of detection accuracy can be set for the closing and opening action of the driving device. In this embodiment, the first load detecting spring 18 is adjusted to provide a high level of accuracy of the load detection, while the second load detecting spring 19 is set to provide a low level of accuracy of the load detection.

The maximum allowable stress of the first load detecting spring 18, as well as that of the second load detecting spring 19, is set to be greater than the stress that is generated when the displacement of the driving device 9 is maximum. Therefore, the stress in each load detecting spring 18, 19 is limited not to reach the maximum allowable stress, whereby each load detecting spring 18, 19 is prevented from a destruction.

A controller 22 is attached to a controller bracket 23 that interconnect the supporting member 15*c* of the first bracket 15 and the second bracket 16 in a manner like a bridge. The controller 22 is disposed on the side of the driving device 9 opposite to the first and second load detecting springs 18 and 19. The controller 22 includes a shutter control circuit 22*a* and limit switches LSD, LSU that are connected to the shutter control circuit 22*a* to detect the rotational displacement of the driving device 9. The limit switches LSD, LSU are operatively connected to the driving device 9 as follows.

Namely, a fixed switch bracket 24 is disposed on a portion of the controller bracket 23 adjacent to the first bracket 15. This fixed switch bracket 24 has a sliding switch bracket 25 that can slide a predetermined distance S in the direction corresponding to the radial direction of the take-up drum 2. The limit switches LSD, LSU are fixed to the sliding switch bracket 23, leaving therebetween the predetermined distance S in the drum-radius direction. The sliding switch bracket 25 is supported and positioned on the neutral position by a torsion spring 26 disposed at the fixed switch bracket 24. Numeral 27 denotes a working lever that is disposed between the limit switches LSD and LSU. The working lever 27 is rotatably supported in a horizontal posture by protuberances 24*a*, 24*b* of the fixed switch bracket 24. At the middle portion of the working lever 27, an operating portion 27*a* is formed that moves into or out of contact with one of the limit switches LSD, LSU when the working lever 27 swings. The end of the working lever 27 that extends from the protuberances 24*a* is connected to the upper end of a link rod 25*b* integrally.

An arm attachment portion 12*e* is formed on the first holder 12 at the portion that is radially adjacent to the link rod 27*b*. One end of a substantially U-shaped working arm 28 rotatably engages with an engagement hole formed in the arm attachment portion 12*e*. The other end of the working arm 28 rotatably engages with an engagement hole formed in the lower end portion of the link rod 27*b*, which is swung by the working arm 28 when the driving device 9 changes its rotational position. Thus, the working lever 27 swings until the corresponding limit switch LSD or LSU works to stop the driving device 9.

The swinging stroke of the working arm 28 for activating the limit switch LSD or LSU is set to be greater than the swing stroke generated during a normal operation without overload (i.e., without any obstacle), and smaller than the swing stroke generated under the overload. It is therefore possible to detect extreme states such as jamming of an obstacle, full opening and full closing that cause an excessive load. In the normal operation, the rotation force generated by the swinging of the working lever 27 is smaller than the output force of the torsion spring 26 that keeps the fixed switch bracket 24 supporting the limit switches LSD and LSU in the neutral position. Thus, the limit switches LSD and LSU can perform detection while being kept in the neutral position.

In contrast, if for an unexpected reason the driving device 9 fails to stop its operation in spite of the overload detection by the limit switch LSD or LSU so as to produce a load exceeding the above-mentioned rotational force, the working lever 27 applies a large rotation force to the limit switch LSD or LSU beyond the above-mentioned stroke. In such a case, the sliding switch bracket 25 supporting the limit switches LSD and LSU is subjected to a force greater than the output force of the torsion spring 26. As a result, the sliding switch bracket 25 slides relative to the fixed switch bracket 24, whereby the limit switches LSD and LSU are protected from the excessive load.

The shutter control circuit 22*a* of this embodiment is designed under the following consideration. Namely, when the shutter curtain 1 is being closed under a strong wind, a large load may be applied to the shutter curtain 1, and the limit switch LSD or LSU for detecting lower or upper limit may erroneously operate. In this case, the shutter curtain 1 cannot be driven any more and, hence, cannot be closed since the limit switch LSD or LSU is in operative or detecting state. In consideration of such an event, the shutter control circuit 22*a* has a manual mode that permits to manually open or close the shutter curtain 1 even if the limit switch LSD or LSU is in operating or detecting state. For instance, the arrangement is such that if a stop switch is kept pushed for ten seconds, the normal operation mode is changed to the manual mode. In the manual mode, the shutter curtain 1 opens or closes regardless of the states of the limit switches LSD and LSU, when an open switch UP or a close switch DOWN is kept pushed. Recovery of the normal mode from this manual mode is performed by prohibiting all operations including open, close and stop for ten seconds.

Excessive load may be generated during starting of the driving device 9. If the detection sensitivity is set not to detect the large starting load, accuracy of the obstacle detection would be impaired undesirably. Therefore, the arrangement may be such that the detection function of the limit switch LSD or LSU is dismissed for e.g., one second at start, so that the impairment of the detection accuracy can be avoided.

In this embodiment, a recognition mechanism is provided for recognizing the detection or non-detection state of the limit switches LSD and LSU when operating the switches. For example, a continuous beep tone is generated for the detection state, and an intermittent tone is generated for the non-detection state, though other type of mechanism such as a lamp indicator may be employed as well. As described above, when the shutter curtain 1 does not work even when the UP or DOWN switch is operated, a check is made for the state of the limit switches LSD and LSU. If it is found that the shutter curtain 1 has been prevented from operating by the functioning of the limit switch LSD or LSU, the operator can switch the operation mode to the manual mode after checking the state of the shutter curtain 1, so that the shutter curtain 1 can safely be opened or closed.

When the shutter curtain 1 has been fully opened, the seat plate at the lowest end of the shutter curtain 1 abuts the lintel so that the limit switch LSU detects that the upper limit position has been reached, whereby the driving device 9 stops to operate. On this occasion, there is a slight time lag between the contact of the seat plate with the lintel and the stop of the driving device 9 after detection by the limit switch LSU. Since the shutter curtain 1 tends to further open during this time lag period, the seat plate may stop giving a stress load to the lintel. Therefore, in this embodiment, the driving device 9 is operated in the closing direction (in the reverse direction) for a predetermined period after the limit switch LSU turns on, so that the shutter curtain 1 is unwound or slacked a little until a slight gap is generated between the seat plate and the lintel.

In the electrically-driven shutter having the described construction, when an excessive load is generated due to jamming of an obstacle, or full opening or full closing of the shutter curtain 1, the driving device 9 is pivoted against the force of the first load detecting spring 18 or the second load detecting spring 19, so that the limit switch LSD or LSU works to automatically stop the driving device 9. Since the driving device 9 is supported so as to rotate in accordance with the motor load (the reaction torque), the motor load can be detected directly from the displacement of the driving device 9. Therefore, load detection with high accuracy can be achieved compared with the conventional indirect detection that relies on detection of rotation variation or current variation. Thus, the accuracy of the obstacle detection or the limit detection can be improved.

In the described embodiment, the pivotal motion of the driving device during closing and opening operations are respectively resisted by the first and second load detecting springs 18 and 19 which do not interfere with each other. The spring constants of the first and second load detecting springs are adjustable independently of each other, so that different levels of detection accuracy can be set for the operations for closing and opening the shutter curtain 1. Thus, for the closing operation, the detection accuracy can be set to a high level so as to reduce the risk of jamming with an obstacle, whereas, for the opening operation, the detection accuracy can be set to a low level so as to ensure smooth and stable operation of the apparatus.

Furthermore, since the spring constant of the load detecting springs 18 and 19 are independently adjustable, adjustment of the detection sensitivity can be performed mechanically, so that the combination of the first and second load detecting springs 18 and 19 can be used for different closure members having different weights. The adjustment of the spring constants of the load detecting springs 18 and 19 can be achieved by causing the respective load detecting springs 18 and 19 to suitable positions. Therefore, the first and second spring fixing members 20, 21 for fixing the first and second load detecting (neutralizing) springs 18, 19 can play the roles of members for adjusting the first and second load detecting springs 18, 19, thus reducing the number of parts to offer a simplified construction.

The first and second load detecting springs 18 and 19 operate exclusively in response to the forward and backward pivotal motions of the driving device 9, respectively, without being interfered by each other. This permits the adjustment of the sensitivity of the first load detecting spring 18 and the sensitivity of the second load detecting spring 19, independently of each other. If both load detecting springs are allowed to interfere with each other such that both load detecting springs produce forces during, for example, forward pivoting of the load detecting spring, the rate of change of the detection sensitivity per unit change in the spring constants becomes too large to enable fine adjustment of the detection sensitivity. The illustrated embodiment is free from this problem because the first and second load detecting springs do not interfere with each other.

In addition, excellent operability is offered by the feature that the positions of the manipulating portions of the butterfly bolts 20*b*, 21*b* for fixing the load detecting springs 18, 19 are adjustable in the direction of circumference of the protuberances 15*d*.

Since the driving device 9 is supported for rotational displacement around the motor shaft axis, it is not necessary to preserve an ample space for accommodating the displacement of the driving device 9. Moreover, this embodiment can be implemented by simple modification of the first and second brackets 15, 16.

Furthermore, in this embodiment, even if overload of the limit switch LSD or LSU has grown large to an extraordinary level, the limit switch LSD or LSU is allowed to slide so as to be protected from such an abnormal load.

In addition, the rotation range, i.e., the maximum allowable displacement, of the driving device 9 is limited and the maximum allowable stresses of the load detecting springs 18, 19 are set to be greater than the stress that is applied under the maximum allowable displacement of the driving device 9. Therefore, the stresses in the load detecting springs 18, 19 are always held below the maximum allowable stresses, so that the breakage of the load detecting springs 18, 19 can be avoided.

It is to be understood that the first embodiment described in the foregoing is only illustrative. For example, it is possible to movably support a reduction gear that makes up the driving device 9 so that the reduction gear serves as a displaceable member that changes the position in accordance with the load variation, so that the load variation is detected based on the displacement of this member. In addition, the present invention can be applied to other types of closure apparatus than the electrically-driven shutter of the first embodiment. For example, the present invention can be applied to a roll type curtain such as an awning.

Figure 10B:
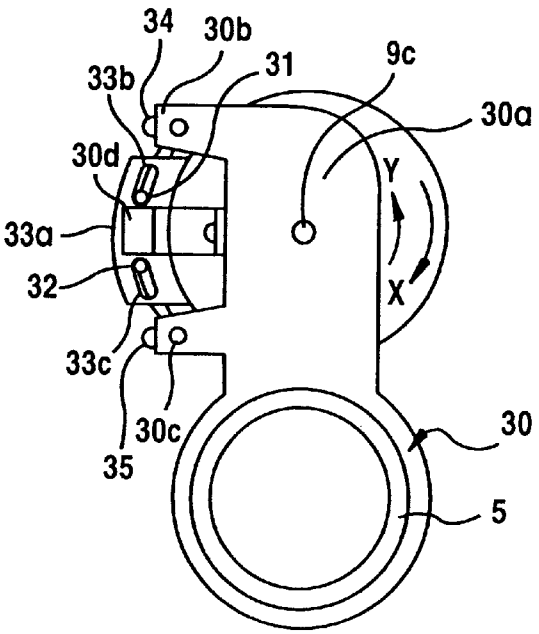
FIG. 10B is a right side view of the second embodiment of the present invention.
Figure 10A:
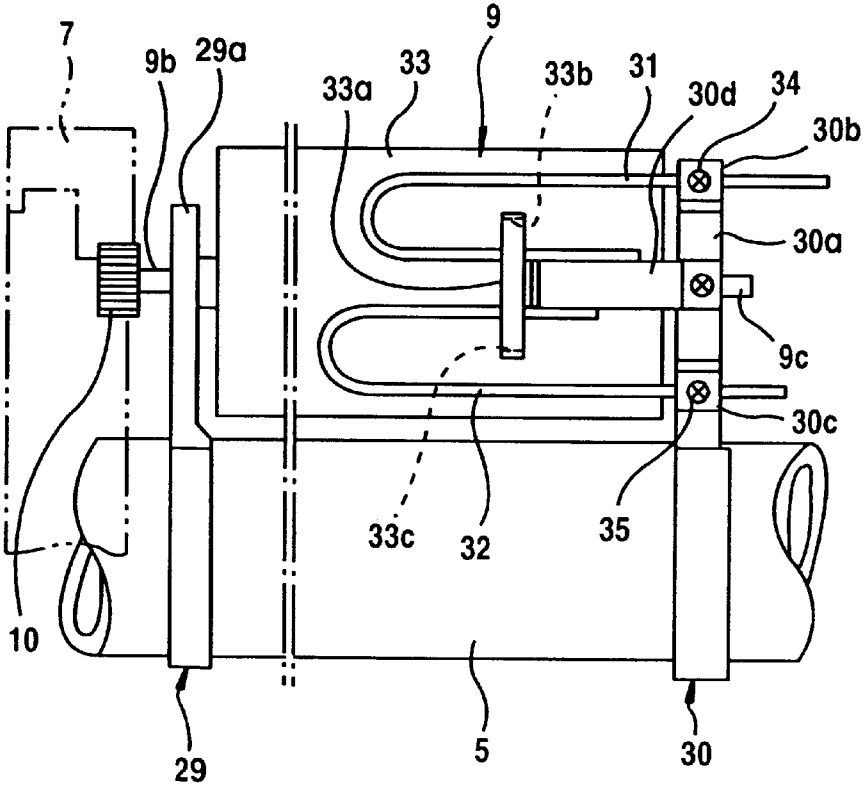
FIG. 10A is a front view of a second embodiment of the present invention.

Next, a second embodiment of the present invention will be explained with reference to FIG. 10. In this Figure, the same elements as those in the first embodiment bear the same reference numerals and detailed description of such elements is omitted.

In this embodiment, first and second brackets 29, 30 fixed to and supported by the fixed shaft 5 have bearings 29*a*, 30*a*. The extending output shaft 9*b* extending from the driving device 9 and rear protruding shaft 9*c* are supported by these bearings 29*a*, 30*a*. Thus, the driving device 9 can rotate around the motor shaft axis. A pair of protuberances 30*b*, 30*c* protrude from the outer peripheral surface of the second bracket bearings 30*a*. First and second load detecting springs 31 and 32 which will be detailed later have ends slidably retained on these protuberances 30*b* and 30*c*. A stopper piece 30*d* is provided on a portion of the second bracket 30 between the pair of protuberances 30*b*, 30*c*so as to extend in the axial direction.

A supporting tab 30*a* is provided on the outer peripheral surface of the casing 33 of the driving device 9 so as to project radially outward and to extend in the circumferential direction. The supporting tab 30*a* has arcuate elongated slots 30*b*, 30*c* which are concentric with the outer peripheral surface of the casing 33.

Each of the first and second load detecting members 31, 32 has been formed by resiliently bending a length of a spring material into a U-like form so that both legs approach each other. The first and second load detecting springs 31, 32 have ends that are retained on the protuberances 30*b*, 30*c* of the second bracket 30. The other ends of these springs are received in the elongated arcuate slots 33*b*, 33*c* formed in the supporting tab 33*a* on the casing 33. The first and second load detecting springs 31, 32 are disposed so as to act between the second bracket 30 which serves as a fixed member and the driving device 9 which serves as the displaceable member. The first and second load detecting springs 31, 32 are adapted to be fixed to the protuberances 30*b*, 30*c* on the second bracket 30 by means of fixing screws 34, 35 which are driven into these protuberances 30*b*, 30*c*. As in the case of the first embodiment, the spring constants of the first and second load detecting springs 31, 32 against the rotational displacement of the driving device 9 are adjustable by sliding these springs to suitable positions on the protuberances 30*b*, 30*c* before these springs are fixed by the fixing screws 34, 35.

The first and second load detecting springs 31, 32 are installed side-by-side at a spacing in the circumferential direction, such that the ends of these springs remote from the ends retained by the protuberances 30*b*, 30*c* are juxtaposed. The juxtaposed ends of the load detecting springs 31, 32 abut against adjacent ends of the aforesaid elongated arcuate sots 33*b*, 33*c* by the resilient forces that act to spread the legs of the respective springs apart from each other. The juxtaposed end portions of the load detecting springs 31, 32 projecting from the respective elongated arcuate slots 33*b*, 33*c* abut the circumferential end surfaces of the stopper piece 30*d* on the second bracket 30, so as to clamp the stopper piece 30*d* therebetween without exerting any urging force on the casing 33. Consequently, the load detecting springs 30, 31 in charged states hold the driving device 9 at the neutral position, i.e., at the mid position in the range of rotation of the driving device 9. As a consequence, the driving device 9 is held without any rattle.

When the driving device 9 is rotationally urged in the direction of the arrow X by an overload, the first load detecting spring 31 is resiliently pressed by the end of the elongated arcuate slot 33*b* in the supporting tab 33*a* in such a direction as to reduce the distance between both legs thereof, thus resisting the rotational displacement of the driving device 9, whereas the end of the second load detecting spring 32 that is restrained by the stopper piece 30*d* is allowed to move along and relative to the elongated arcuate slot 33*c*, so that the second load detecting spring 32 does not produce any force which would resist the rotational displacement of the driving device 9 in the direction of the arrow X. Conversely, the rotational displacement of the driving device 9 is resisted by the second load detecting spring 32. It is thus possible to obtain different levels of the detection accuracy for the opening and closing operations, by independently adjusting the first and second load detecting springs to desired levels of the spring constants.

Thus, the second embodiment also permits different levels of detection accuracy to be set for the opening and closing operations, thus offering stable and smooth operation for opening the shutter curtain 1 while ensuring high sensitivity for the detection of obstacle during closing of the shutter curtain 1. Further, in the second embodiment as described, the ends of the first and second load detecting springs 31, 32 remote from the protuberances 30*b*, 30*c* are resiliently pressed against the stopper piece 30*d* so as to be pre-loaded. When the driving device 9 is rotationally displaced from the neutral position by an overload, the pre-loaded load detecting spring is further loaded so as to resist the displacement of the driving device 9. Consequently, the change in the spring force per unit amount of rotational displacement of the driving device 9 is reduced as compared to the case of the first embodiment in which the spring force of each load detecting spring is zero when the driving device is held at the neutral position. The second embodiment therefore can offer a higher level of the detection accuracy than that obtained with the first embodiment. In addition, any tendency of the driving device to rattle at the neutral position is suppressed appreciably.

Figure 11B:
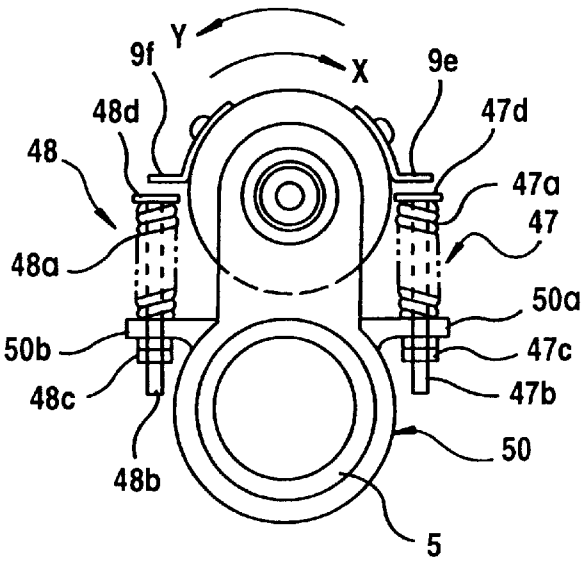
FIG. 11B is a right side view of the third embodiment of the present invention.
Figure 11A:
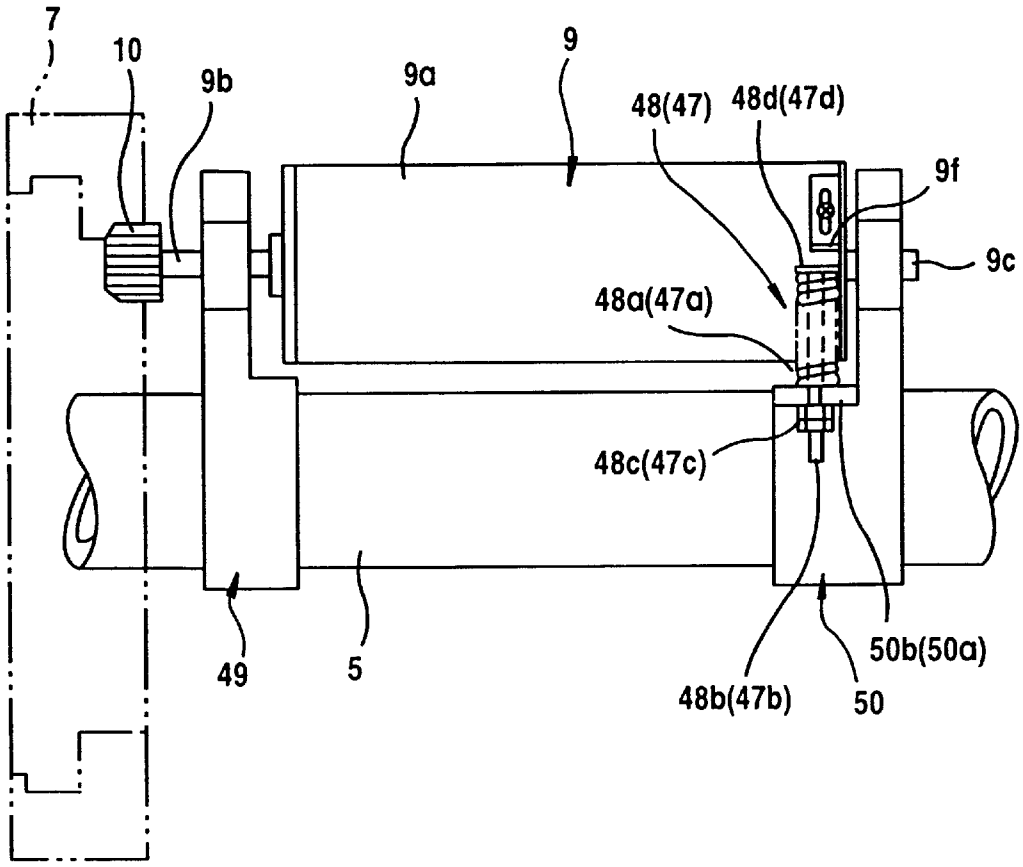
FIG. 11A is a front view of a third embodiment of the present invention.

A third embodiment of the present invention will now be described with reference to FIG. 11. In this embodiment, the first and second brackets 36, 37 fixed to and supported by the fixed shaft 5 have bearing portions 36*a*, 37*a*. The extending output shaft 9*b* extending from the driving device 9 and rear protruding shaft 9*c* of the same are supported by the bearing portions 36*a*, 37*a*. First and second linear load detecting springs 38 and 39 have base ends that are received in and supported by spring-retaining through-holes 37*b*, 37*c* which are formed in an outer peripheral portion of the bearing portion 37*a* in the second bracket 37 and which are spaced from each other in the circumferential direction. Free ends of the first and second load detecting springs 38 and 39 are received in and supported by spring mounting holes 36*b*, 36*c* which are formed in an outer peripheral portion of the bearing portion 36*a* in the first bracket 36. The first and second load detecting springs 38, 39 are prevented from coming off, by means of bends 38*a*, 39*a* of the free ends of the springs 38, 39 and retainer members 38*b*, 39*b* which are provided on the base ends of these springs 38, 39.

A fixing member 40 has a pair of spring-receiving arcuate slots 40*a* and 40*b* which are concentric with the outer peripheral surface of the casing 9*a* of the driving device 9 and which receive the first and second load detecting springs 38 and 39 for axial sliding motion. The fixing member 40 further has a slide engaging piece 40*c* that axially slidably engages with a ridge 9*d* which is formed on the outer peripheral surface of the casing 9*a* so as to extend in the axial direction of the casing 9*a*. The fixing member is slidingly moved to a suitable position on the outer peripheral surface of the motor casing 9*a* and is fixed thereto by means of a screw 40*d*, whereby the driving device 9 is held in a neutral position while the first and second load detecting springs 37, 39 adjusted to have predetermined spring constants are connected between the driving device 9 and the first and second brackets 36, 37. In this state, the first and second load detecting springs 38 and 39 are held in contact with the adjacent ends of the arcuate spring receiving slots 40*a*, 40*b* formed in the fixing member 40.

A rotational displacement of the driving device 9 in the direction of the arrow X due to an overload causes the end of the arcuate spring receiving slot 40*a* to deflect the first load detecting spring 38 and, accordingly, is resisted by the first load detecting spring 38. In the meantime, the second load detecting spring 39 doe not exert any force on the driving device 9, since this spring 39 is allowed to freely move along and relative to the spring-retaining arcuate slot 40*b*. In contrast, a rotational displacement of the driving device 9 in the direction of the arrow Y is resisted by the second load detecting spring 39. In this third embodiment, the first and second load detecting spring 38 and 39 inherently have different spring constants so that different levels of detection accuracy can be obtained in the opening and closing operations. The difference in the spring constants can be further adjusted finely by means of the fixing member 40 the position of which is adjustable in the axial direction. Thus, the third embodiment also provides different levels of detection accuracy in the opening and closing operations, such that a high level of detection accuracy for detecting any obstacle during closing operation and stable and smooth closing operation are simultaneously achieved.

The third embodiment may be modified such that the first and second load detecting springs have an equal spring constant. In such a case, the different levels of detection accuracy can be implemented such that the limit switches LSD and LSU of the controller 22 are activated by different amounts of rotational displacement of the driving device 9. Such a different in the amount of rotational displacement an be achieved by arranging such that the distance between the limit switch LSD and the operation lever 27 in the neutral position is different from the distance between the limit switch LSU and the operation lever 27, so that the limit switches LSD and LSU are turned on in response to different amplitudes of rotation of the driving device 9, i.e., in response to different levels of load. Obviously, the arrangement may also be such that the first and second load detecting springs 38 and 39 are cantilevered either by the first bracket 36 or by the first bracket 37.

Figure 12B:
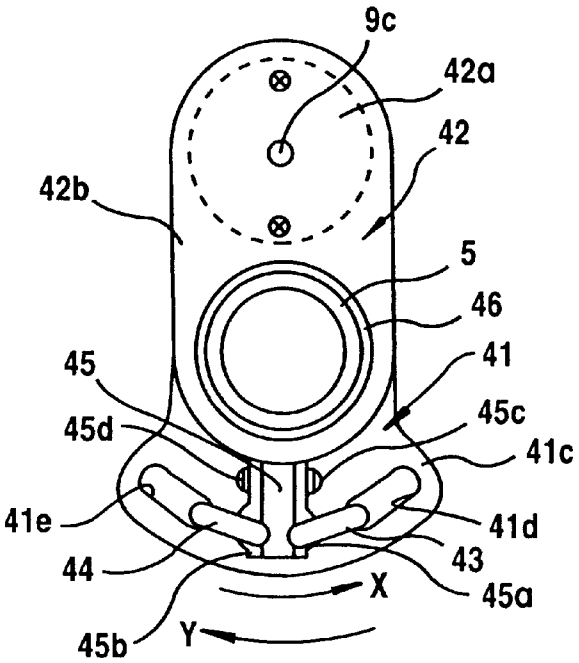
FIG. 12B is a right side view of the fourth embodiment of the present invention.
Figure 12A:
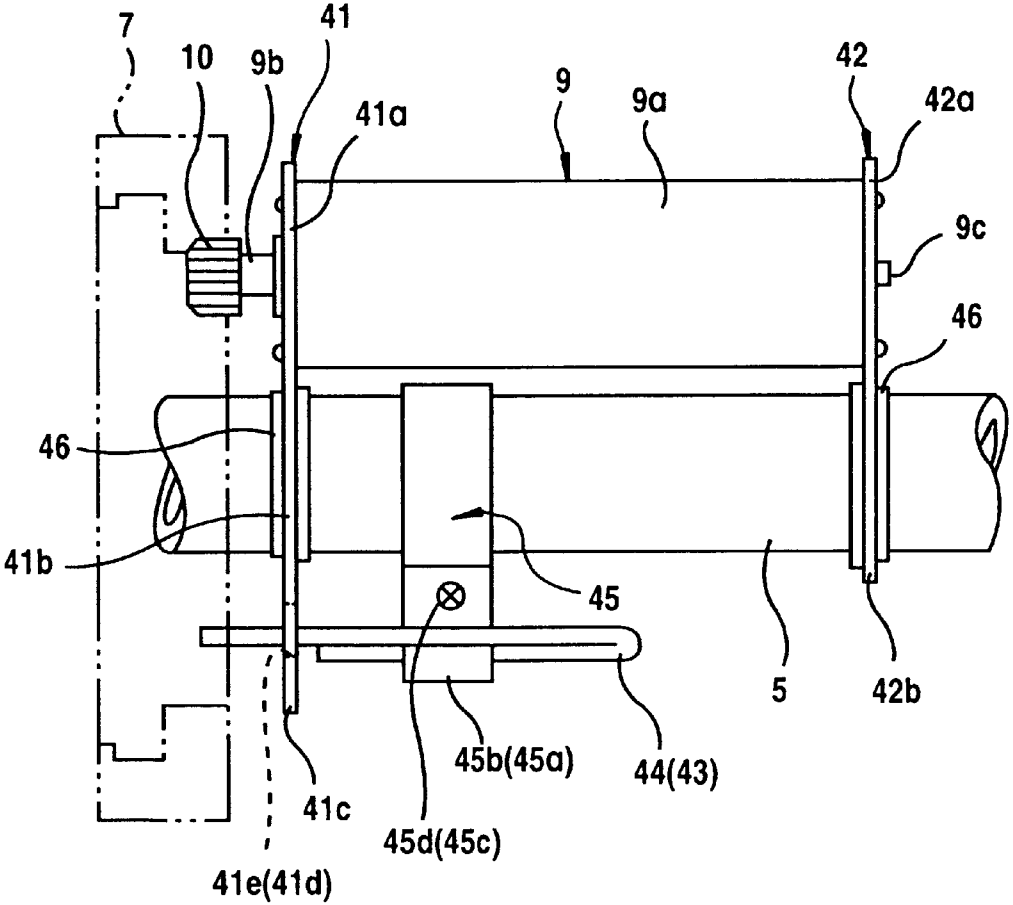
FIG. 12A is a front view of a fourth embodiment of the present invention.

A fourth embodiment of the present invention will now be described with reference to FIG. 12. In this embodiment, the driving device 9, which is the displaceable member displaceable in accordance with the load variation, pivots around the axis of the fixed shaft 5.

In this embodiment, fixing portions 41*a* and 42*a* of first and second motor attachment plates 41 and 42 are fixed to both end surfaces of the driving device 9. Bearing portions 41*b* and 42*b* for the fixed shaft 5 are formed integrally on the first and second motor attachment plates 41 and 42, so that the driving device 9 is supported for rotation around the fixed shaft 5. Thus, the driving device 9 can rotate around the axis of the fixed shaft 5. In addition, the first motor attachment plate 41 is provided with an extending portion 41*c* in which are formed a pair of spring-receiving arcuate slots 41*d*, 41*e* concentric with the outer peripheral surface of the fixed shaft 5. Substantially U-shaped first and second load detecting springs 43, 44, similar to those employed in the first embodiment, have ends slidably received in and held by the spring-receiving arcuate slots 41*d*, 41*e*. A fixed bracket 45 is secured to the fixed shaft 5 so as not to be rotatable relative to the fixed shaft 5. The fixed bracket 45 has spring mounting portions 45*a*, 45*b* which slidably receive other ends of the first and second load detecting springs 43, 44. Screws 45*c* and 45*d* are adapted to be tightened and loosened so as to fix and release the load detecting springs 43 and 44.

As mentioned above, the driving device 9 is supported rotatably around the fixed shaft 5, and is drivingly connected to the internally-toothed ring gear 7 constituting the take-up drum 2, via the output gear 10. Thus, the driving device 9 is supported in the neutral position in the normal operation of opening and closing the shutter curtain 1, so that the internally-toothed ring gear 7 is rotated in a predetermined direction. The driving device, under an extraordinarily large load torque due to jamming of an obstacle or full open or full close of the shutter curtain 1, pivots about the fulcrum constituted by the fixed shaft 5, against the force of either the first load detecting spring 43 or the second load detecting spring 44. The pivotal displacement of the driving device 9 is afforded by the rolling of the output gear 10 along the internal teeth of the ring gear 7. The rotational displacement of the output gear 10, i.e., the rotational displacement of the driving device 9, takes place in the direction counter to the above-mentioned predetermined direction of rotation of the internally-toothed ring gear 7. This rotational displacement of the output gear 10 is sensed by a sensor which is not shown. More specifically, when the driving device 9 is held in the neutral position, the first and second load detecting springs 43 and 44 are held in contact with the adjacent en edges of the spring-receiving arcuate slots 41*d*, 41*e*. A rotational displacement in the X-direction of the extended portion 41*c* of the first motor attachment plate 41, resulting from application of an overload on the driving device 9, causes the first load detecting spring 43 to be resiliently deformed such that its legs are spread apart from each other. Thus, the rotational displacement in the direction of the arrow X is resisted by the first load detecting spring 43. In the meantime, the second load detecting spring 44 is allowed to move along and relative to the spring-receiving arcuate sot 41*e*, without producing any force which would interfere with the force produced by the first load detecting spring 43. Likewise, a rotational displacement in the direction of the arrow Y is resisted by the second load detecting spring 44, without interfered by the first load detecting spring 43.

Thus, in the fourth embodiment of the present invention, the driving device 9 serving as the displaceable member is arranged to pivot about the fulcrum constituted by the fixed shaft 5. The arrangement is such that the driving device 9 is automatically de-energized when it is pivotally moved about the axis of the fixed shaft 5 due to an overload acting thereon. The spring constants of the first and second load detecting springs 43, 44 are independently adjustable also in this embodiment, so that different levels of detection accuracy can be set for the opening and closing operations. Consequently, high accuracy in detection of obstacle during closing and high levels of smoothness and stability of the closing operation are simultaneously achieved.

Figure 13B:
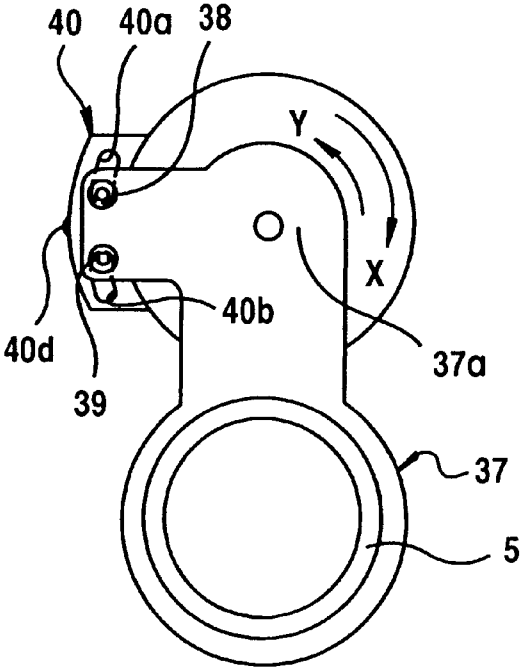
FIG. 13B is a right side view of the fifth embodiment of the present invention.
Figure 13A:
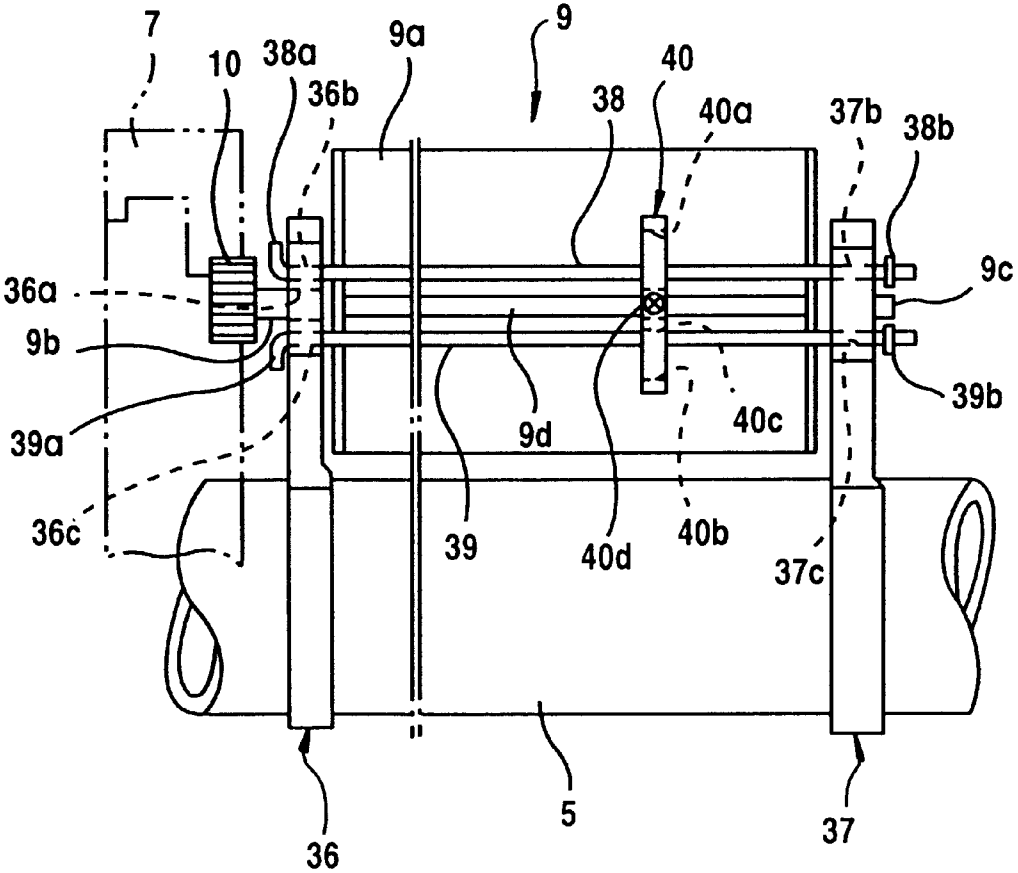
FIG. 13A is a front view of a fifth embodiment of the present invention.

FIG. 13 shows a fifth embodiment which employs first and second load detecting springs 47 and 48 incorporating coiled compression springs.

More specifically, this embodiment has first and second brackets 49 and 50 which are fixed to the fixed shaft 5 and which support the driving device 9 for rotation about the axis of the motor shaft. The second bracket 50 has spring retaining portions 50*a*, 50*b* that project radially outward from the outer peripheral surface thereof. As stated above, the first and second load detecting springs 47 and 48 have first and second coiled compression springs 47*a* and 48*a* and further include bolts 47*b*, 48*b* received in the coiled compression springs 47*a*, 48*a* and having ends movably inserted in the spring retaining portions 50*a*, 50*b*, and adjusting double nuts 47*c*, 48*c* screwed to the ends of the bolts 47*b*, 48*b* projecting from the spring retaining portions 50*a*, 50*b*. The first and second compression coiled springs 47*a*, 48*a* are loaded to act between the heads 47*d*, 48*d* and the spring retaining portions 50*a*, 50*b* so as to urge the heads 47*d*, 48*d* of the bolts, thereby producing resisting forces. Abutment members 9*e* and 9*f* are fixed to the casing 9*a* of the driving device 9. When the driving device 9 is rotationally displaced in the direction of the arrow X or Y, the abutment member 9*e* or 9*f* abuts the bolt head 47*d* or 48*d*, so as to be resisted by the compression spring 47*a* or 48*a*. Spring constants of the first and second load detecting springs 47 and 48 can be adjustable independently to desired values by adjusting the double nuts 47*c* and 48*c*, whereby different levels of detection accuracy can be obtained for the opening operation and closing operation.

What is claimed is:

1. A closure apparatus for a structure, comprising:

a closure member extendable to close an opening of the structure and retractable to open the opening of the structure;

a fixed member adapted to be fixed to the structure;

a driving device including a motor connected to the closure member to extend and retract the closure member, one of the driving device and the motor being a displaceable member rotatably connected to the fixed member;

a forward load detecting spring disposed between the displaceable member and the fixed member to resist a forward rotational displacement of the displaceable member;

a backward load detecting spring disposed between the displaceable member and the fixed member to resist a backward rotational displacement of the displaceable member; and at least one sensor detecting a forward displacement and a backward displacement of the displaceable member.

2. The closure apparatus of claim 1, wherein the forward load detecting spring does not resist the backward rotational displacement of the displaceable member; and the backward load detecting spring does not resist the forward rotational displacement of the displaceable member.

3. The closure apparatus of claim 1, wherein each of the forward and backward load detecting springs is formed substantially in a U-shape or a linear shape.

4. The closure apparatus of claim 3, wherein each of the forward and backward load detecting springs has a first end fixed to one of the displaceable member and the fixed member and a second end inserted into a slot of the other of the displaceable member and the fixed member.

5. The closure apparatus of claim 1, wherein the displaceable member includes a motor shaft rotatable about an axis of the motor shaft, and wherein the motor shaft is rotatable about the fixed member.

6. The closure apparatus of claim 5, further comprising:

a take-up drum attached to the closure member and the motor shaft, rotatable with the motor shaft to roll up and unroll the closure member.

7. The closure apparatus of claim 1, wherein the fixed member includes a fixed shaft, wherein the displaceable member is rotatable about an axis of the fixed shaft.

8. The closure apparatus of claim 1, wherein the at least one sensor detects rotational displacements of the displaceable member.

* * * * *